US010408089B2

(12) United States Patent
McDonagh

(10) Patent No.: US 10,408,089 B2
(45) Date of Patent: Sep. 10, 2019

(54) ASSEMBLY FOR SUPPORTING AN ANNULUS

(71) Applicant: ROLLS-ROYCE plc, London (GB)

(72) Inventor: Stephen McDonagh, Derby (GB)

(73) Assignee: ROLLS-ROYCE plc, London (GB)

( * ) Notice: Subject to any disclaimer, the term of this patent is extended or adjusted under 35 U.S.C. 154(b) by 164 days.

(21) Appl. No.: 15/645,374

(22) Filed: Jul. 10, 2017

(65) Prior Publication Data

US 2018/0016941 A1 Jan. 18, 2018

(30) Foreign Application Priority Data

Jul. 15, 2016 (GB) ..... 1612293.9

(51) Int. Cl.
*F01D 25/24* (2006.01)
*F01D 9/06* (2006.01)
*F01D 25/28* (2006.01)

(52) U.S. Cl.
CPC ..... *F01D 25/246* (2013.01); *F01D 9/065* (2013.01); *F01D 25/243* (2013.01); *F01D 25/28* (2013.01); *F05D 2220/32* (2013.01); *F05D 2230/644* (2013.01); *F05D 2260/30* (2013.01); *F05D 2260/36* (2013.01); *F05D 2260/941* (2013.01)

(58) Field of Classification Search
CPC ..... F01D 25/246; F01D 9/065; F01D 25/243; F01D 25/28; F05D 2220/32; F05D 2230/644; F05D 2260/30; F05D 2260/36; F05D 2260/941
USPC ..... 415/142
See application file for complete search history.

(56) References Cited

U.S. PATENT DOCUMENTS

| | | | | |
|---|---|---|---|---|
| 3,877,762 | A | 4/1975 | Dennison | |
| 5,292,227 | A | 3/1994 | Czachor et al. | |
| 2013/0067930 | A1 | 3/2013 | Paradis | |
| 2015/0044032 | A1* | 2/2015 | Paradis | F01D 25/246 415/134 |

(Continued)

FOREIGN PATENT DOCUMENTS

| | | |
|---|---|---|
| EP | 1 057 975 A2 | 12/2000 |
| EP | 1 149 987 A2 | 10/2001 |

(Continued)

OTHER PUBLICATIONS

Dec. 16, 2016 Search Report issued in British Patent Application No. 1612293.9.

(Continued)

*Primary Examiner* — Aaron R Eastman
(74) *Attorney, Agent, or Firm* — Oliff PLC

(57) ABSTRACT

The annulus is bound by an inner hub wall and an outer casing and includes a support structure, the support structure bearing the inner hub wall; at least one spigot passing through the hub wall and at least one strut arranged to pass through the spigot of the inner hub wall and across the annulus. The strut has a first end having an abutment arm extending to form an abutment shoulder. Alignable holes pass through the abutment arm and the spigot and these holes are configured to receive a cross pin which is in turn configured to fit snugly through the holes. The configuration is such that, the abutment rim and abutment shoulder are located radially inwardly of the holes and cross pin and outside of the annulus.

8 Claims, 6 Drawing Sheets

(56) References Cited

U.S. PATENT DOCUMENTS

2015/0260057 A1* 9/2015 Farah ..... F01D 25/24 60/796
2015/0322815 A1* 11/2015 Scott ..... F01D 25/24 415/200
2015/0337682 A1* 11/2015 Yeager ..... F01D 9/065 415/1
2015/0345330 A1* 12/2015 Budnick ..... F01D 25/162 415/177
2015/0345338 A1* 12/2015 Yeager ..... F01D 25/162 415/177
2015/0345400 A1* 12/2015 Scott ..... F01D 9/065 60/796
2015/0354411 A1* 12/2015 Scott ..... F01D 25/24 415/200
2015/0354413 A1* 12/2015 Scott ..... F01D 25/24 415/200
2016/0032763 A1* 2/2016 Grogg ..... F01D 25/08 184/6.11
2016/0177757 A1* 6/2016 Sarawate ..... F01D 11/005 415/1
2017/0058696 A1* 3/2017 Manteiga ..... F01D 9/02
2017/0081966 A1* 3/2017 Huizenga ..... F01D 5/02
2017/0107837 A1* 4/2017 Huizenga ..... F01D 5/284
2017/0204734 A1* 7/2017 Groves, II ..... F01D 9/065
2017/0241282 A1* 8/2017 Boeck ..... F01D 11/003
2017/0241289 A1* 8/2017 Hidaka ..... F01D 25/16
2017/0292449 A1* 10/2017 Agara ..... F02C 7/06

FOREIGN PATENT DOCUMENTS

EP 2 192 271 A2 6/2010
EP 2 192 274 A2 6/2010
EP 3075967 A1 10/2016
WO 2010/024736 A1 3/2010

OTHER PUBLICATIONS

Nov. 28, 2017 Search Report issued in European Patent Application No. 17 18 0538.

* cited by examiner

ASSEMBLY FOR SUPPORTING AN ANNULUS

FIELD OF THE INVENTION

The present disclosure concerns the supporting of an annulus defined by an inner support structure and an outer casing. Whilst not strictly limited thereto, the disclosed arrangement has application in a turbine stage of a gas turbine engine to support an annulus across which aerofoil members of the stage extend.

BACKGROUND TO THE INVENTION

FIG. 1 illustrates one example of a prior known gas turbine engine in which a strut of the invention might be used. With reference to FIG. 1, a gas turbine engine is generally indicated at 10, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 10 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

It is necessary within a gas turbine engine such as that of FIG. 1 to provide structural support for the engine rotors (be they in the fan, compressor or turbine section of the engine). This has been achieved in prior known designs by means of ball and roller bearings. The bearings are directly or indirectly attached to static bearing support structures, which provide a load path across the annulus by means of discrete struts. At the relatively cold end of the engine (e.g in the fans and compressor) these struts can be exposed to the annulus gas stream and even double as aerodynamic vanes. However, in hot turbine environments, the very high temperature annulus air can prohibit structural vanes. In such cases it is often necessary to isolate the struts from the hot annulus air by passing them through hollow, cooled, turbine vanes. FIG. 2 illustrates such a prior known arrangement.

In the turbine arrangement of FIG. 2, alternate rotating 22 and static 23 rows of a turbine are shown. The static row 23 comprises an array of hollow vanes 24. The rotating rows comprise a disc 25 rotatably mounted in a bearing 26. An outer perimeter of the disc 25 provides an array of retaining slots 27 into which blades (not shown) can be received. The hollow vanes 24 span an annular space which is bounded by a radially inner end wall 28 and a radially outer end wall 29. As can be seen a strut 30 is provided to extend through the hollow vane 24. The strut 30 passes from beneath a hub wall 28*a* of the support structure, through the radially inner end wall 28 and vane 23 and is secured in position by a spigot 31 extending from outside of the radially outer end wall 29, through the casing 29*a* and into a recess 32 provided in the strut 23.

FIG. 3 shows the strut fastening arrangement of FIG. 2 to the casing 29*a* in more detail. As can be seen the spigot is in the form of hollow dowel 31 which passes through a casing wall 29*a* and into recess 32 of the strut 30. A radial bolt is driven through dowel 31 and the recess 32 and screwed into position by means of complementary screw threads 34 provided in the strut 30 recess 32 and on the shaft of bolt 33.

In an assembled turbine, the struts 30 are typically interspersed around the circumference of the hub wall 28*a* between service tubes (not shown) resulting in a spoked structure. The spoked structure has the non-structural vanes 24 installed over the struts 30 and service tubes before being fitted into the outer casing 29*a*. Once in the outer casing 29*a*, the previously described spigot (hollow dowel 31) and radial bolt 33 arrangement is used to secure the struts 30 with respect to the casing 29*a*.

The tolerance control required for the outside diameter to the struts and the positioning of the radial holes for the hollow dowels 31 previously required top level machining of the spoked assembly. (i.e. with the struts already attached). As the tolerance control could not be maintained if the struts were removed and then re-installed, it was considered desirable to specify a permanent attachment method for the struts 30 in the region of the hub wall 28*a*. Bolted joints were considered undesirable. Welding has been considered as an alternative, but the weld bead at heat affected zone of the weld has been found greatly to reduce the material properties in the region of the weld and significantly increase the likelihood of defects. Consequently spigot location has been adopted as a method of permanently attaching the struts 30 onto a bearing support structure. The arrangement uses abutment shoulders arranged externally of the annulus extending to form an abutment arms 37 through which cross pins are received to secure the struts 30 to a bearing support structure which is enclosed by the hub wall 28*a*.

FIG. 4 shows the strut fastening arrangement of FIG. 2 at the hub wall 28*a* in more detail. As can be seen the strut 30 passes from the annulus and through the radially inner end wall 28 where a region adjacent an end of the strut 30 flares before extending as an abutment arm 37 with a uniform cross-section. An abutment shoulder 34 is defined by a recess in the arm 37 adjacent the flared region in a direction distal to the radially inner end wall 28. An integrally formed spigot defines a through hole in the hub wall 28*a* into which the strut 30 is received. The spigot may be formed integrally with the hub wall 28*a* or optionally comprises a separate component. A hole passes through the abutment arm 37 and receives a cross pin 36. A fillet radius 35 of the spigot defines an abutment rim which abuts the abutment shoulder 34 serving to restrict movement of the strut 30 along a radius of the annulus.

STATEMENT OF THE INVENTION

According to a first aspect there is provided an assembly for supporting an annulus, the annulus bound by an inner hub wall and an outer casing, the assembly comprising; a support structure, the support structure bearing the hub wall; at least one spigot passing through the hub wall, the spigot defining an abutment rim and at least one strut arranged to pass through the spigot of the hub wall and across the annulus, the strut comprising;

a first end having an abutment arm and alignable holes passing through the abutment arm and the spigot, the holes configured to receive a cross pin which is in turn configured to fit snugly through the holes;

an abutment shoulder of the abutment arm for engaging the abutment rim the configuration being such that, the abutment rim and abutment shoulder are located radially inwardly of the holes and cross pin and outside of the annulus.

The hub wall may form part of a support structure which typically is arranged at the centre of a turbine engine having an axis coincident with the engine axis. A separate component defining a second annulus across which hollow vanes of a turbine stage extend may be arranged around the circumference of the support structure during assembly. In such arrangements, the strut can be inserted through a cavity of a hollow vane and be subsequently secured to a casing arranged circumferentially around the separate component which defines the second annulus.

In some embodiments the spigot is integrally formed with the hub wall. Optionally, the spigot is a component separate from the hub wall and is configured to be fit snugly into a hole provided in the hub wall, the spigot configured to receive the strut abutment arm in a snug fit. As is the case with assembly of prior known arrangements, the struts of the assembly of the invention are first located in the spigots and are then more permanently retained by the cross pins which are pressed into the in-line machined holes which pass through both the support structure (for example through aligned holes in the spigot) and the abutment arm of the strut.

A disadvantage of the prior known arrangement arises from the locating of a stress concentrating feature (e.g the fillet radius) at a plane of maximum bending stress. This stress concentration greatly reduces the load bearing capability of the design. By moving the abutment shoulder inside the annulus using the assembly as herein described, the present invention mitigates this problem and improves the load bearing capability of the strut. Also, prior known arrangements have restricted inspection access to the stress concentrating fillet radii such that any crack propagation may go undetected.

Movement of the abutment shoulder away from the supporting inner hub wall and outside the annulus allows the spigot on the annulus side of the hub wall to be smoothly blended into the strut's external profile thereby maintaining a strong/stiff profile, free of stress concentrating features, in the assembly where the loading is at its highest.

Embodiments of the invention maintain a relatively thin abutment shoulder on the spigot such that any crack propagation is likely to break through the abutment shoulder thickness long before it has propagated circumferentially and resulted in a rupture. Consequently cracks are much more likely to be detected and dealt with before any rupture occurs. The positioning of the abutment shoulder radially inwardly of the cross pin and outside of the annulus also ensures that, in the event of a circumferential crack arising about the fillet (which would remain outside of the annulus), the strut is not completely dislocated from its desired position. The strut may, for example, still be held in a length of spigot and retained by the cross pin.

Movement of the abutment shoulder to outside the annulus also permits much easier access for inspection. In the prior art arrangement any cracks emanating from the fillet are hidden and could go undetected for some time. Such cracks have the potential to propagate circumferentially without detection. If an undetected crack in the fillet propagated to rupture, this would break the connection between the protruding strut and the rest of the structure. With the present invention, the plane of maximum bending stress is located in an accessible region allowing any crack propagation to be more easily detected and addressed before rupture.

Thus, locating the abutment surface and associated stress concentrating fillet to a much lower stress region in accordance with the invention greatly reduces the likelihood of crack initiation. A further benefit of the proposed arrangement is that earlier crack detection is facilitated introducing an element of fail safe.

The invention is particularly well suited to gas turbine engines where highly loaded discrete structural supports (the struts of the assembly of the invention) are required to bridge an annulus and where, for reasons of engine efficiency, the cross-section of the struts within the annulus is required to be minimised.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF DRAWINGS

Embodiments of the invention will now be described by way of example only, with reference to the Figures, in which:

FIGS. 1 to 4 illustrate prior art arrangements and have been discussed above.

DETAILED DESCRIPTION OF EMBODIMENT

Figure 1:
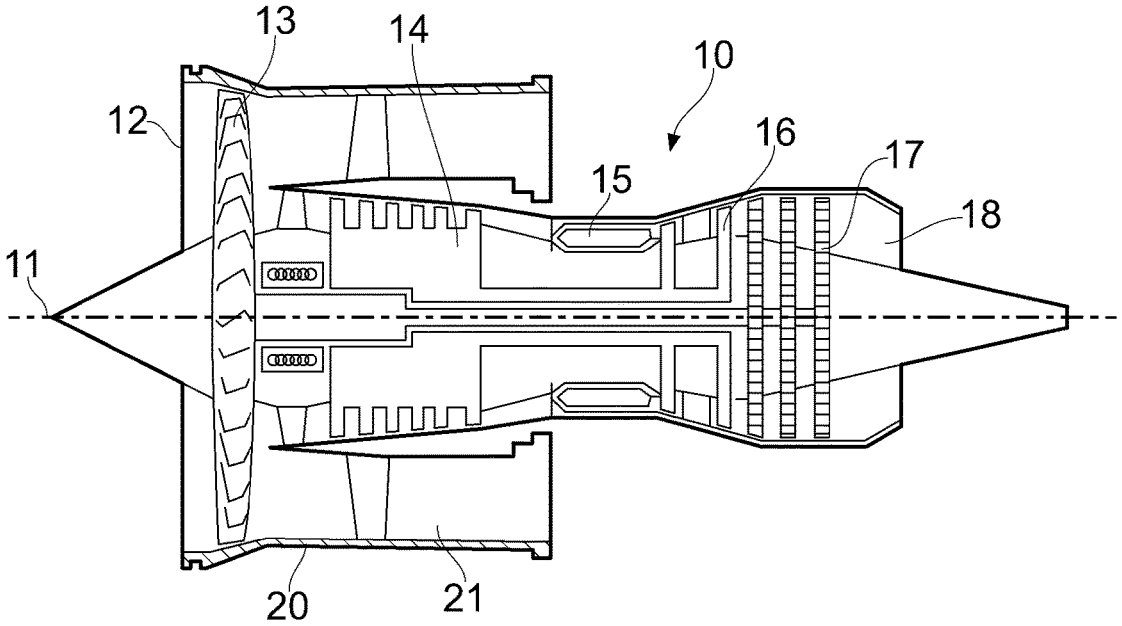
FIG. 1 Related Art
FIG. 1 is a sectional side view of a gas turbine engine into which assemblies of the invention might usefully be incorporated.
Figure 2:
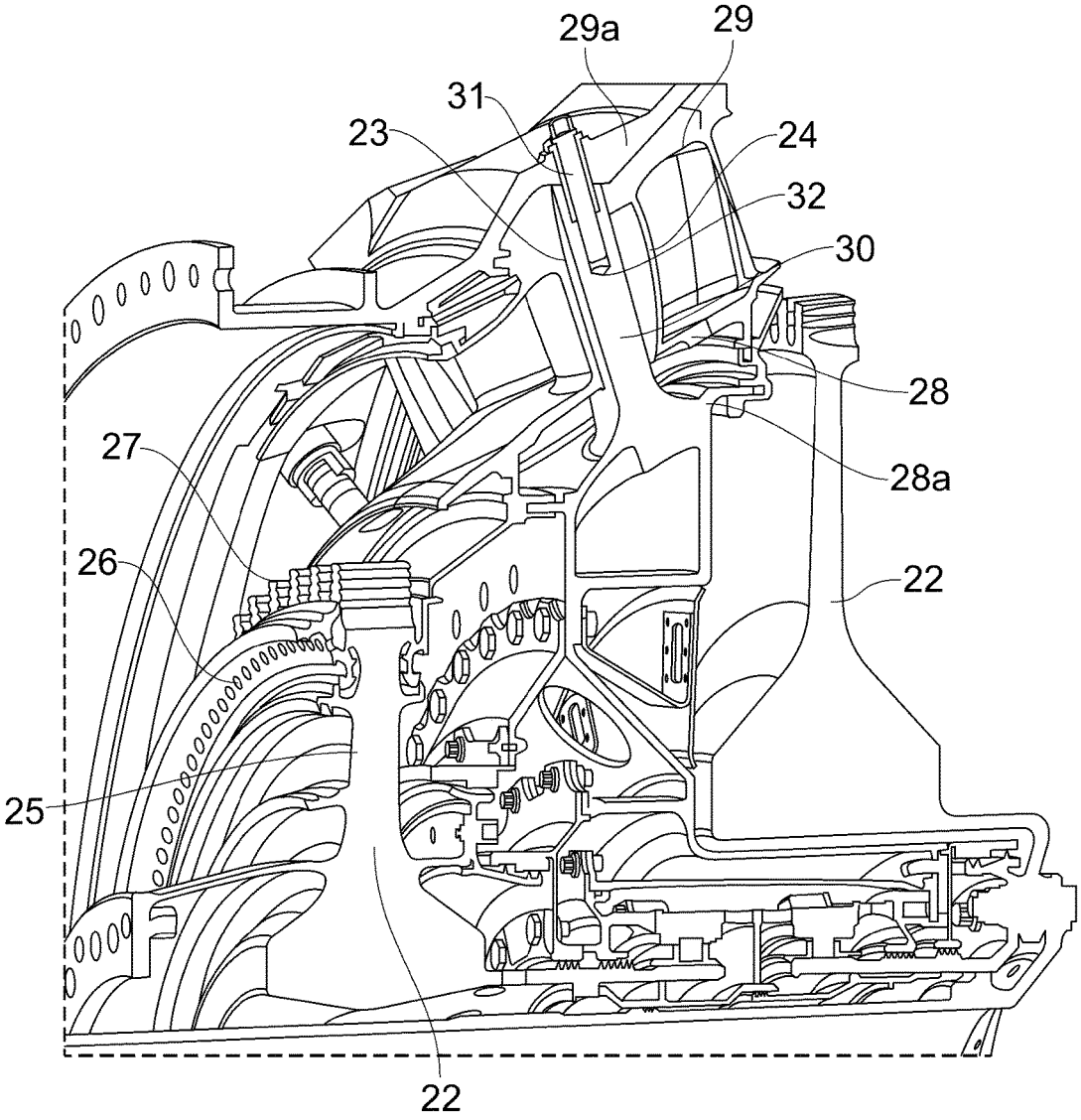
FIG. 2 Related Art
FIG. 2 is a sectional view displaying the arrangement of a strut inside a hollow vane of a turbine stage in an arrangement known in the prior art.
Figure 3:
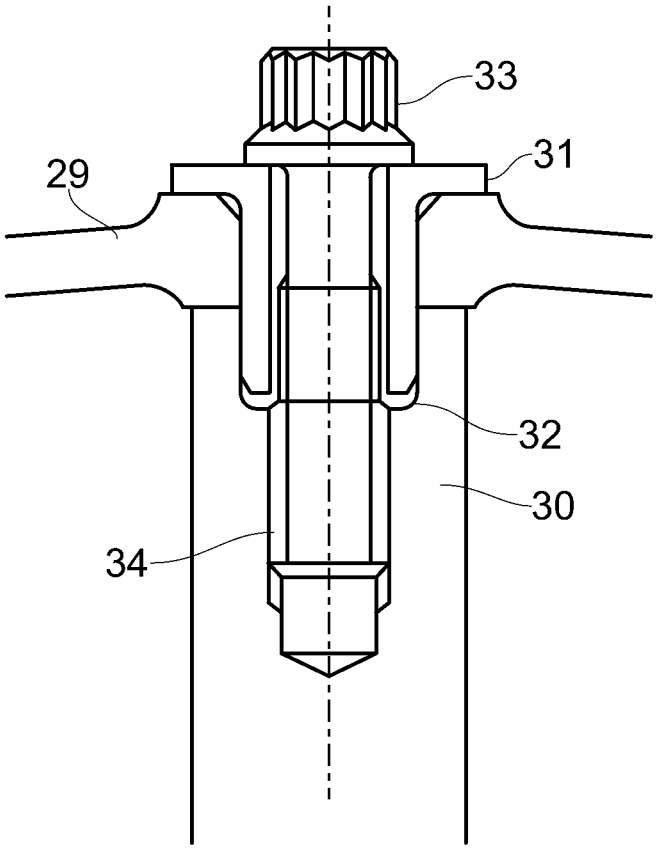
FIG. 3 Related Art
FIG. 3 is a more detailed view of the assembly of FIG. 2 in the region of a radially outer wall of the annulus of a turbine.
Figure 4:
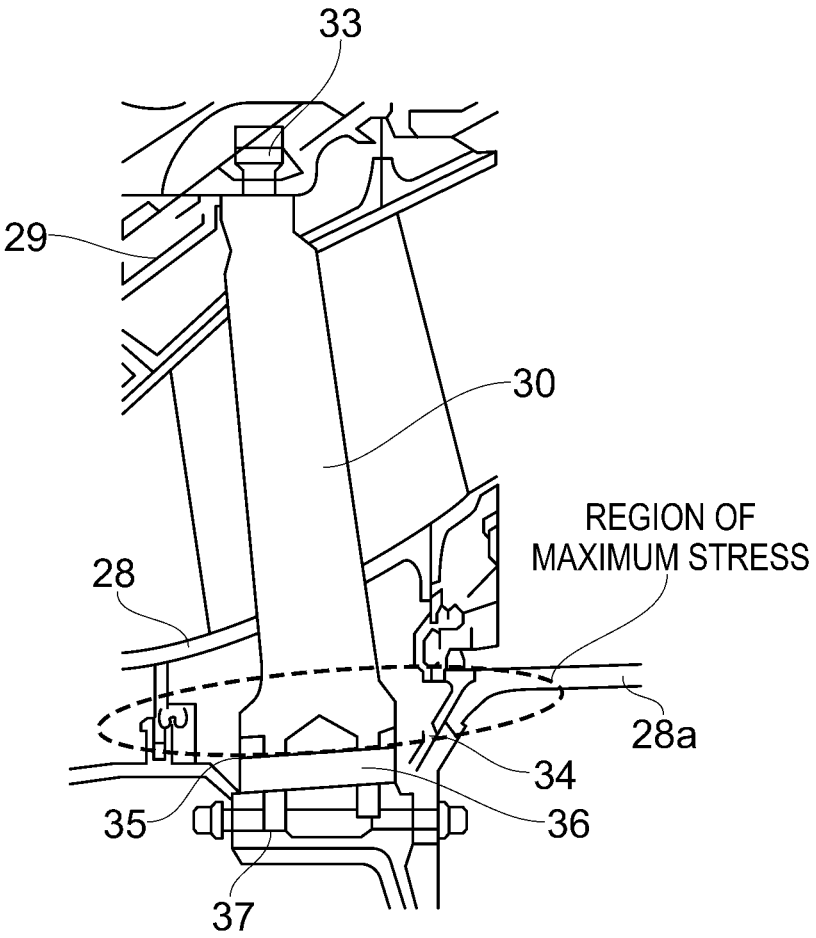
FIG. 4 Related Art
FIG. 4 is a more detailed view of the assembly for FIG. 2 in the region of a radially inner wall of the annulus of the turbine.
Figure 5A:
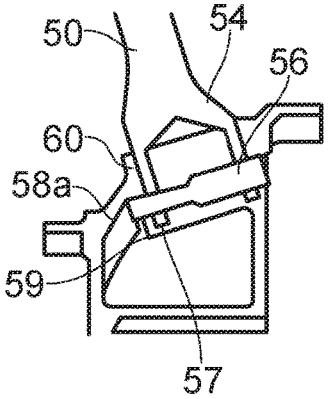
FIG. 5*a* shows a first sectional view of an assembly in accordance with an embodiment of the invention.
Figure 5B:
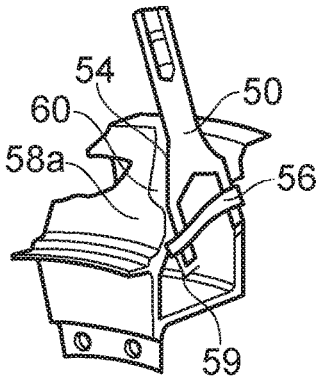
FIG. 5*b* shows a second sectional view of the assembly of FIG. 5*a;*
Figure 5C:
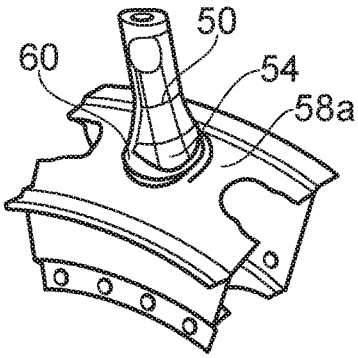
FIG. 5*c* shows a view of the assembly of FIGS. 5*a* and 5*b* from within the annulus looking towards the hub wall.

FIGS. 5*a, b* and *c* illustrate different views of an embodiment of the invention. As can be seen in these figures an assembly in accordance with the invention comprises a strut 50 and a cross pin 56. The strut 50 includes an abutment arm 54 configured to be received through a hole in a hub wall 58*a* which has an integral spigot 60. The abutment arm 54 of strut 50 has an abutment shoulder 57 configured to pass through the spigot 60 and abut against the abutment rim 59. The strut protrudes from the hub wall 58*a* and extends radially towards an outer casing (not shown). The cross pin 56 passes through aligned machined holes, through the abutment arm 54 and a support structure (not shown). As can be seen best in FIG. 5*c*, the spigot 60 on the annulus side extends just beyond the hub wall 58, before blending smoothly into the abutment arm profile.

Figure 6:
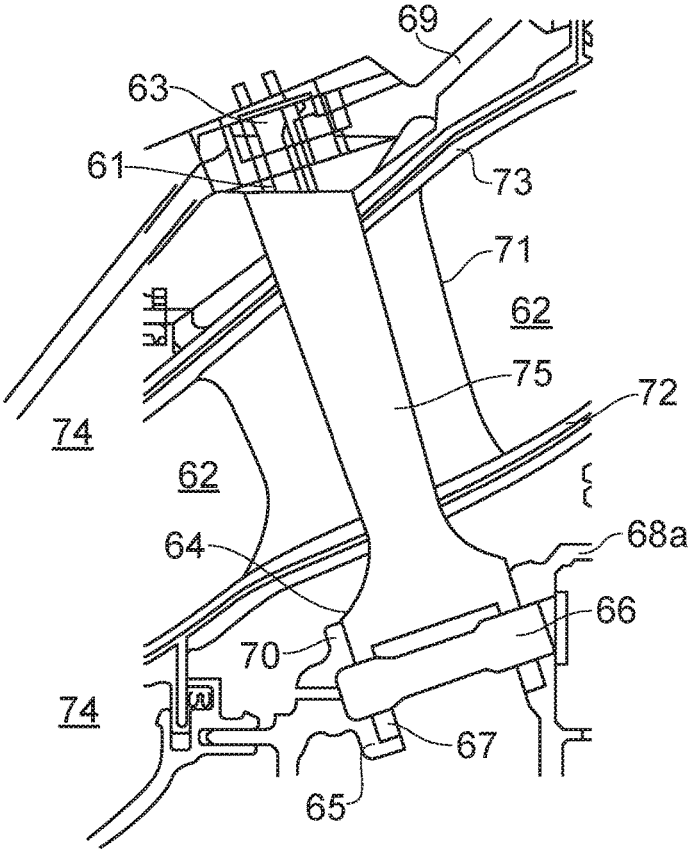
FIG. 6 illustrates a section of an embodiment of an assembly in accordance with the invention secured in position across an annulus of a turbine.
Figure 7:
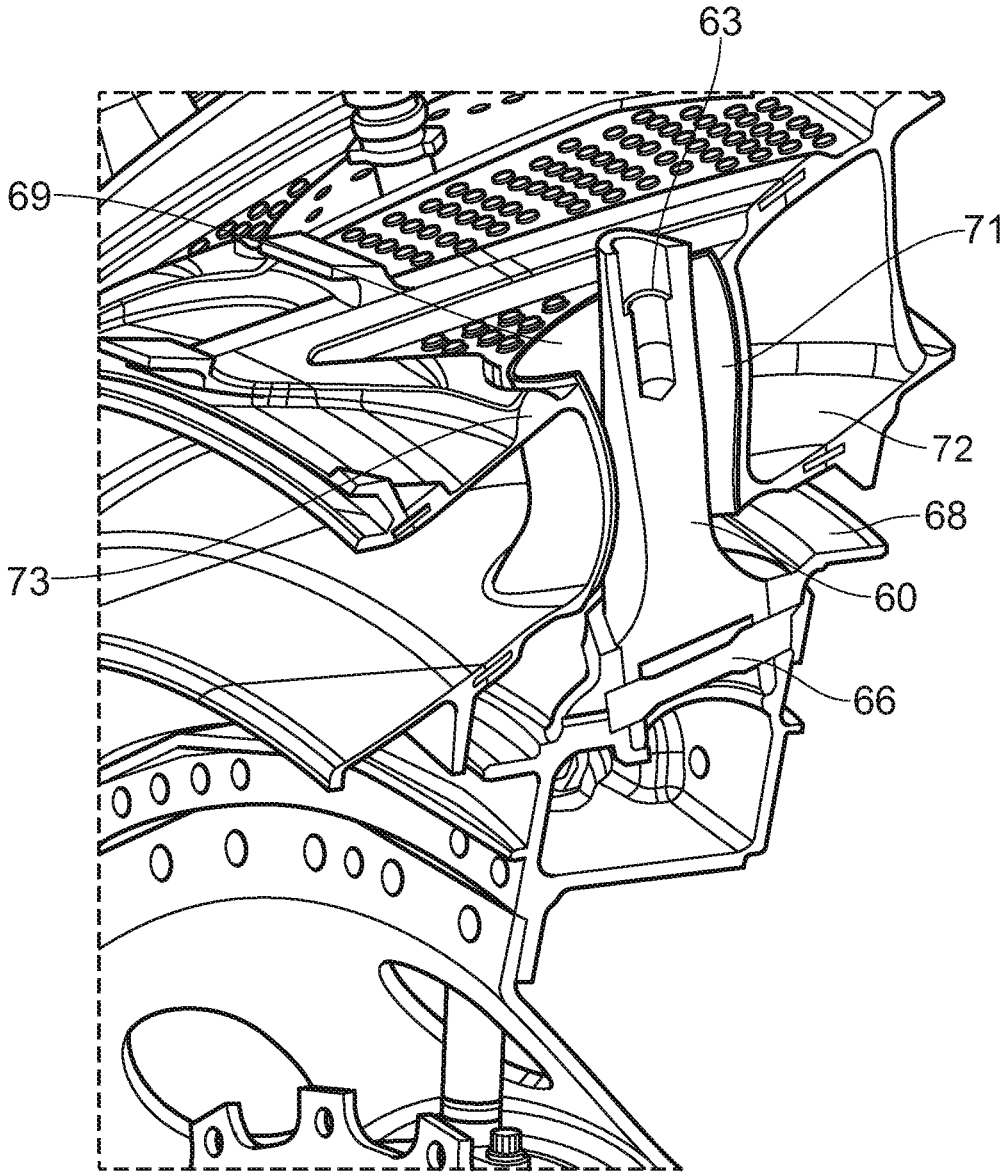
FIG. 7 shows a more detailed sectional view of the assembly of FIG. 6.

As can be seen from FIG. 6 and FIG. 7, a strut 75 of an assembly in accordance with the invention is secured across an annular cavity 74 between an inner hub wall 68*a* and an outer casing 69. Each strut 75 passes through the internal cavity of a hollow vane 71. An annular gas path 62 of the turbine is defined between the vane 71 inner annulus wall 72 and the vane 71 outer annular wall 73. The strut 75 is held in a spigot 70 with the strut's abutment arm 64 extending into the annular cavity 74 and abutment shoulder 67 restrained by an abutment rim 65 of the spigot 70. A cross pin 66 is passed through aligned holes in the spigot 70 and abutment arm 64 securing the strut to the hub wall 68*a*. The holes and cross pin 66 pass through the abutment arm 64 outside of the annular cavity 74. The annular cavity 74 is bounded at its outer circumference by a casing 69. In a manner similar to the prior art, an end of the strut 75 passes through a spigot 61 in the casing 69 and a radial bolt 63 is then passed through the spigot and is threadedly engaged with the strut 75.

During assembly, a separate component defining the hollow vane 71 and a annular gas path 62 (defined by a vane inner annulus wall 72 and a vane outer annulus wall 73) may be lowered over the strut 75 before the casing 69 is positioned and radial bolt 63 subsequently engaged. Alternatively, the strut 75 might be inserted through the already located hollow vane 71 before the casing 69 is located in position and the radial bolt 63 engaged in the strut 75.

It will be understood that the invention is not limited to the embodiments above-described and various modifications and improvements can be made without departing from the scope of the invention as defined in the appended claims. Except where mutually exclusive, any of the features may be employed separately or in combination with any other features and the disclosure extends to and includes all combinations and sub-combinations of one or more features described herein.

The invention claimed is:

1. An assembly for supporting an annulus, the annulus bound by an inner hub wall and an outer casing, the assembly comprising
   - a support structure, the support structure bearing the inner hub wall;
   - at least one spigot passing through the inner hub wall, the spigot incorporating an abutment rim; and
   - at least one strut arranged to pass through the spigot of the inner hub wall and across the annulus, the strut comprising:
     - a first end having an abutment arm and a plurality of alignable holes passing through the abutment arm and the spigot, the holes configured to receive a cross pin which is in turn configured to fit snugly through the holes, the abutment arm receiving each of the plurality of alignable holes, and cross pin therethrough, outside of the annulus; and
     - an abutment shoulder of the abutment arm for engaging the abutment rim, the configuration being such that the abutment rim and abutment shoulder are located radially inwardly of the holes and cross pin and outside of the annulus.

2. The assembly as claimed in claim 1 wherein the spigot is formed integrally with the inner hub wall.

3. The assembly as claimed in claim 1 wherein the spigot is provided with an external profile shaped to blend with a profile of the strut diameter which protrudes into the annulus when the strut is arranged in the annulus.

4. The assembly as claimed in claim 1 further comprising, in a second end of the strut, a threaded hole, a bolt configured for passing through a second spigot of the outer casing, and wherein the bolt is configured to threadedly engage the threaded hole.

5. The assembly as claimed in claim 1 further comprising an annular component defining a second annulus, the second annulus bounded by a blade inner end wall and a blade outer end wall and having one or more hollow blades extending radially between the blade inner end wall and blade outer end wall wherein when correctly assembled, the second annulus is contained within the first annulus and one or more struts extend through a cavity in one or more of the one or more hollow blades.

6. The assembly as claimed in claim 1 wherein the annulus forms part of a turbine stage.

7. The assembly as claimed in claim 6 wherein the turbine stage is one of a plurality of turbine stages which form part of a gas turbine engine.

8. The assembly as claimed in claim 1 wherein the abutment shoulder is an end portion of the abutment arm.

* * * * *